United States Patent [19]

Nordlof

[11] Patent Number: 4,700,907

[45] Date of Patent: Oct. 20, 1987

[54] STOCK ADVANCING APPARATUS WITH CONTROL ARM DAMPING

[76] Inventor: Richard D. Nordlof, 3312 Crest Rd., Rockford, Ill. 61107

[21] Appl. No.: 25,606

[22] Filed: Mar. 13, 1987

[51] Int. Cl.[4] ..... B65H 59/00

[52] U.S. Cl. ..... 242/75.5; 242/75.51; 226/44

[58] Field of Search ..... 242/75.42, 75.43, 75.5, 242/75.51, 75.3, 45; 226/44

[56] References Cited

U.S. PATENT DOCUMENTS

| | | | |
|---|---|---|---|
| 2,580,717 | 1/1952 | Ballou | 242/75.5 |
| 2,637,506 | 5/1953 | Laycock | 242/75.42 |
| 2,886,257 | 5/1959 | Hill | 242/75.5 |
| 3,366,147 | 1/1968 | Picanol | 242/75.5 |
| 3,529,571 | 9/1970 | Good et al. | 242/75.5 X |
| 3,650,490 | 3/1972 | Saunders | 242/75.5 X |
| 4,153,218 | 5/1979 | Martin | 242/75.3 |
| 4,464,916 | 8/1984 | Grew et al. | 226/44 X |
| 4,527,751 | 7/1985 | Grosz et al. | 242/75.51 |
| 4,555,071 | 11/1985 | Nordlof | 242/75.5 |
| 4,578,621 | 3/1986 | Nordlof | 318/6 |

*Primary Examiner*—S. Levy

*Assistant Examiner*—Steven M. Dubois

*Attorney, Agent, or Firm*—Vernon J. Pillote

[57] ABSTRACT

A stock advancing apparatus for advancing stock to or from a stock processing machine. The stock advancing apparatus includes a drive motor for driving the stock advancing apparatus and a stock loop control arm mounted for swinging movement and adapted to engage a stock loop intermediate the stock advancing apparatus in the stock processing machine, and mechanism responsive to swinging movement of the control arm controls operation of the drive motor to maintain a loop in the stock between the stock advancing apparatus and the stock processing machine. A control arm cam is mounted for movement with the stock loop control arm and a cam follower is pressed into engagement with the control arm cam by a spring. The control arm cam and cam follower and spring are constructed and arranged to apply torque to the control arm in a direction to oppose upward movement of the control arm and which increases as the control arm moves upwardly and decreases as the control arm moves downardly. Manually adjustable means are provided for adjusting the minimum deflection of the spring.

17 Claims, 13 Drawing Figures

Fig. 5.
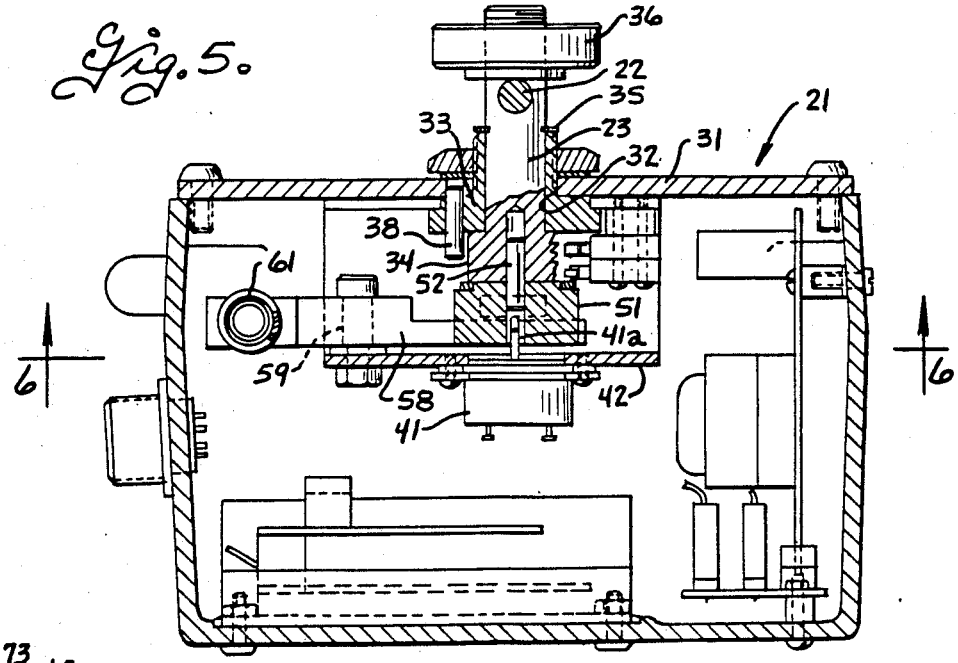
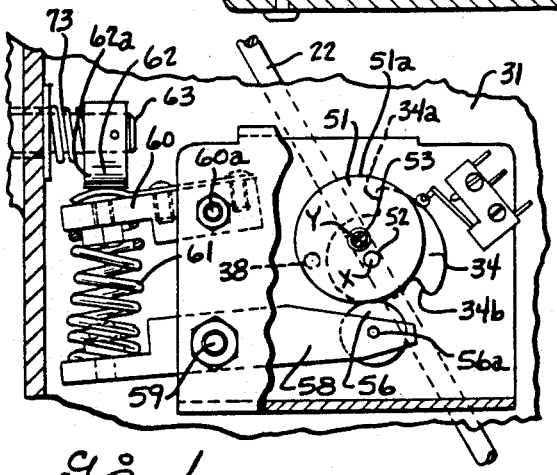
Fig. 6.
Fig. 8.
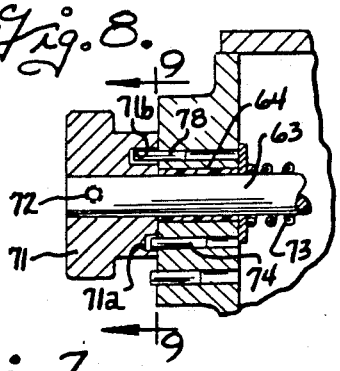
Fig. 7.
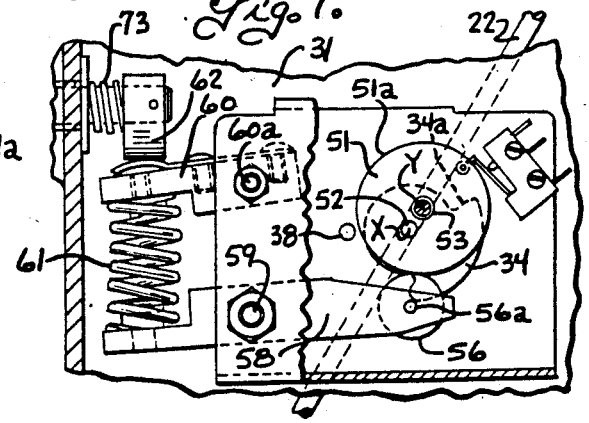
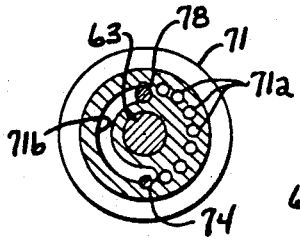
Fig. 9.

STOCK ADVANCING APPARATUS WITH CONTROL ARM DAMPING

BACKGROUND OF THE INVENTION

The present invention relates to power operated stock advancing apparatus of the type having a swingably mounted control arm for sensing the size of a loop of stock between the stock advancing apparatus and a stock processing machine and for controlling operation of a drive motor for the stock advancing apparatus in a manner to maintain a loop of stock between the stock advancing apparatus and the processing machine. The stock advancing apparatus may comprise a stock reel that effects advance of the stock by winding or unwinding stock from a coil. The stock advancing apparatus can also comprise powered stock feed rollers or powered stock straightening rollers. Some stock advancing apparatus such as disclosed in U.S. Pat. No. 4,555,071 provide a cam on the dancer arm shaft that actuates a switch to start and stop the drive motor for the stock advancing apparatus to maintain a loop in the stock. Stock advancing apparatus have also heretofore been made as disclosed in U.S. Pat. No. 4,578,621 in which the dancer arm operates a speed control potentiometer to produce a variable control voltage correlative with the angular position of the dancer arm to increase and decrease the speed of the stock advancing apparatus in a manner to maintain a loop in the stock between the stock advancing apparatus and the subsequent stock processing machine.

In many stock processing machines such as punch presses and the like, the stock is moved in step fashion through the stock processing machine to provide a dwell time for the machine to operate on the stock. This stepped movement of the stock through the stock processing machine produces relatively rapid changes in the size of the stock loop and the dancer arm moves angularly with changes in size of the stock loop. The dancer arm is commonly counterbalanced to adjust the force exerted by the stock loop sensing arm on the stock, and adapt the apparatus for different types and weights of stock. In practice, the dancer arm not only moves up or down with changes in the size of the stock loop caused by the stepped advance of the stock through the processing machine, but also sometimes bounces out of contact with the stock, particularly at high operating speeds and when the arm is counterbalanced to apply only a light force on the stock in the loop. Bouncing of the control arm on the stock loop can not only cause excessive cycling of the drive motor for the stock advancing mechanism but can also adversely affect control of the size of the stock loop.

It has heretofore been proposed to attach a spring or a fluid type shock absorber to the stock loop control arm at a location spaced from its pivot axis to control bouncing of the stock loop control arm. However, it is common practice in dancer arm controlled stock advancing apparatus to adjust the operating angle of the stock loop control arm as well as the length of the stock loop control arm and the counterbalancing of a stock loop control arm to accommodate different types and weights of stock, and a spring or fluid type shock absorber attached to the stock loop control arm is not readily adjustable to accommodate the various different control arm adjustments and to effect different control arm dampening action for different operations.

SUMMARY OF THE INVENTION

It is an object of the present invention to provide a stock advancing apparatus of the type having a stock loop control arm for controlling operation of the drive motor for the stock advancing apparatus, and which has an improved arrangement for damping movement of the stock loop control arm.

Another object of this invention is to provide a stock advancing apparatus in accordance with the foregoing object in which damping movement of the control arm oscillation can be readily adjusted.

Accordingly, the present invention provides a stock advancing apparatus for advancing flexible stock to or from a stock processing machine comprising, support means, rotary stock advancing means on the support means, a drive motor for driving the stock advancing means, AND a stock loop control arm mounted on the support means for swinging movement about a control arm axis. The stock loop control arm is adapted to engage a loop of stock intermediate the stock advancing apparatus and the stock processing machine and to be moved upwardly thereby through a range of control arm positions, and means responsive to movement of the control arm about the control arm axis controls operation of the drive motor to maintain a loop in the stock between the stock advancing apparatus and the stock processing machine. A means is provided for damping movement of the stock loop control arm about said control arm axis, the damping means including a control arm cam means mounted for turning movement with the control arm about the control arm axis, cam follower means operatively engaging said control arm cam means, and spring means engaging said cam follower means for pressing the cam follower means against the control arm cam means. The control arm cam means and the cam follower means and the spring means are constructed and arranged to apply torque to the control arm in a direction to oppose upward movement of the control arm and which torque increases as the control arm moves upwardly through at least a portion of said range of said range of control arm positions and decreases as the control arm moves downwardly.

Provision is advantageously made for selectively presetting a minimum deflection of the spring means, and the control arm cam means is arranged to increase the deflection of the spring means as the control arm moves upwardly.

BRIEF DESCRIPTION OF THE DRAWINGS

FIG. 5 is a fragmentary horizontal sectional view taken on the broken line 5—5 of FIG. 3;

FIGS. 6 and 7 are fragmentary vertical sectional views taken on the plane 6—6 of FIG. 5 and illustrating parts in different moved positions;

FIG. 8 is a fragmentary sectional view taken on the plane 8—8 of FIG. 7;

FIG. 9 is a fragmentary sectional view taken on the plane 9—9, of FIG. 8;

DETAILED DESCRIPTION

Figure 1:
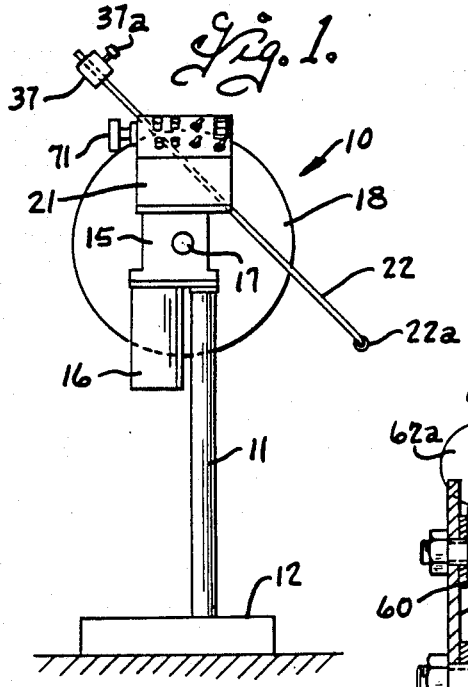
FIG. 1 is a side elevational view of a stock advancing apparatus embodying the present invention.
Figure 2:
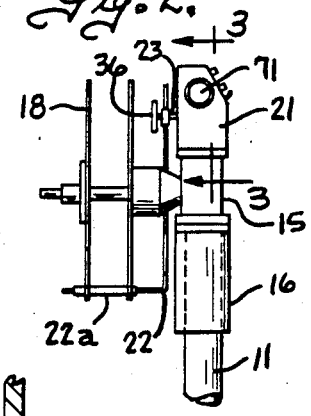
FIG. 2 is a fragmentary end elevational view of the stock advancing apparatus of FIG. 1.
Figure 4:
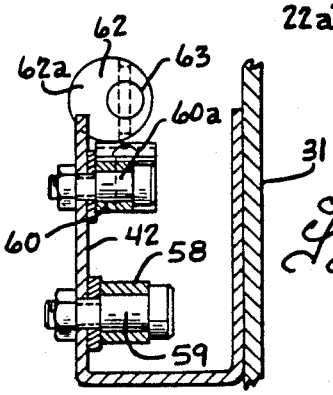
FIG. 4 is a fragmentary vertical sectional view taken on the plane 4—4 of FIG. 2.
Figure 10:
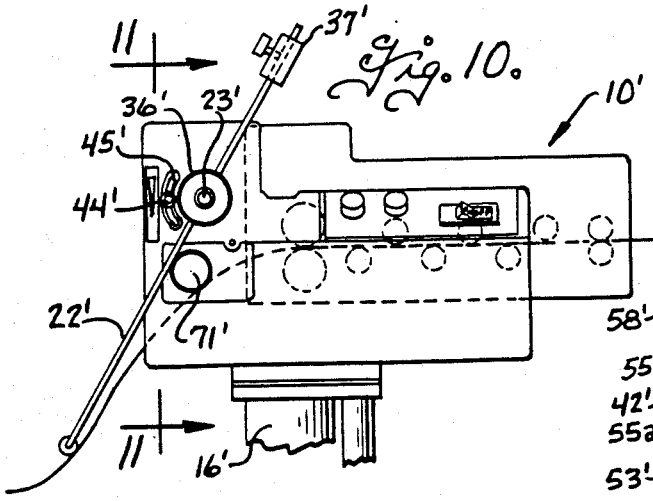
FIG. 10 is a fragmentary side elevational view of a modified form of stock advancing apparatus.
Figure 13:
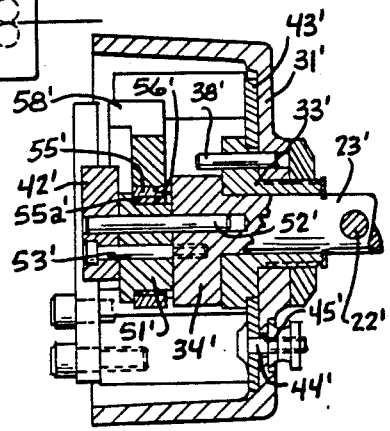
FIG. 13 is a fragmentary horizontal sectional view taken on the plane 13—13 of FIG. 12.

The present invention relates to a stock advancing apparatus 10 for advancing flexible strip or wire stock of indeterminate length to or from a wire processing machine in a manner to maintain a predetermined slack loop in the stock between the stock advancing apparatus and the processing machine. The stock advancing apparatus may comprise a stock reel as shown in FIG. 1 which advances the stock by winding or unwinding the stock from a coil under the control of a stock loop sensing arm. The stock advancing apparatus can also comprise powered rotary stock feed rollers for feeding stock to or from the stock processing machine under the control of a stock loop sensing arm, or power driven stock straightening rollers operated under the control of a stock loop sensing arm. The stock advancing apparatus is of the type in which the stock loop control arm controls operation of a drive motor for the stock advancing apparatus in a manner to maintain a slack loop in the stock. In the embodiment illustrated in FIG. 1, the stock advancing apparatus 10 is in the form of a stock reel, which stock reel 10 is conveniently adapted to payout or rewind stock at either side of the stock reel and from either the top or bottom of the coil, to supply stock or receive stock from a stock processing machine (not shown) that performs some operation on the stock. In the embodiment illustrated in FIG. 10, the stock advancing apparatus 10 is in the form of power driven stock feeding and/or straightening rolls. The stock processing machine may, for example, comprise a cyclicly operable press for forming or blanking articles from the strip stock. Such stock processing machines customarily have a feed mechanism for advancing the stock in step fashion through the stock processing machine in timed relation with the cycling of the machine, and the stock advancing apparatus is arranged to supply stock at a rate such as to maintain a loop in the stock between the stock advancing apparatus and the processing machine.

The stock advancing apparatus is preferably self-supporting so that it can be moved into positions at the inlet or outlet side of the processing machine and, as shown in FIG. 1, is mounted on the upper end of a post 11 having a floor engaging base 12. The stock advancing apparatus includes a drive head 15 mounted on the upper end of the post and an electric drive motor 16 for driving the stock advancing apparatus. In the stock reel illustrated, the motor 16 is operatively connected through gearing (not shown) in the drive head to drive a shaft 17 and a coil support 18 of conventional construction suitable for supporting a coil of stock, is mounted on the shaft 17 for rotation therewith.

A control box 21 is mounted on the drive head 15 and a stock loop control arm 22 is mounted on a control arm shaft 23 for swinging movement through a first range of control arm positions at one side of the stock reel and through a second range of control arm positions at the stock reel, between lower and raised positions. Means are provided in the control box 21 for controlling operation of the drive motor 16 to rotate the stock advancing apparatus in a manner to maintain a loop in the stock. The control apparatus for controlling operation of the drive motor 16 in response of the angular position of the stock loop sensing arm may be of the type having a progressively variable speed control for varying the speed of the drive motor and advance of stock by the stock advancing apparatus in accordance with the angular position of the stock loop sensing arm to maintain a loop in the stock, or of the type using an on/off control for starting and stopping the drive motor as required to maintain a loop in the stock. In the embodiment of FIGS. 1–9, the invention is shown and applied to a stock advancing apparatus of the type having a progressively variable speed control, which may conveniently be of the type disclosed in U.S. Pat. No. 4,578,621, the disclosure of which is incorporated herein by reference. The invention is shown applied to a stock advancing apparatus having an on/off type motor drive control in FIGS. 10–13 which on/off type motor drive control can conveniently be of the type disclosed in U.S. Pat. No. 4,555,071, the disclosure of which is also incorporated herein by reference.

Figure 3:
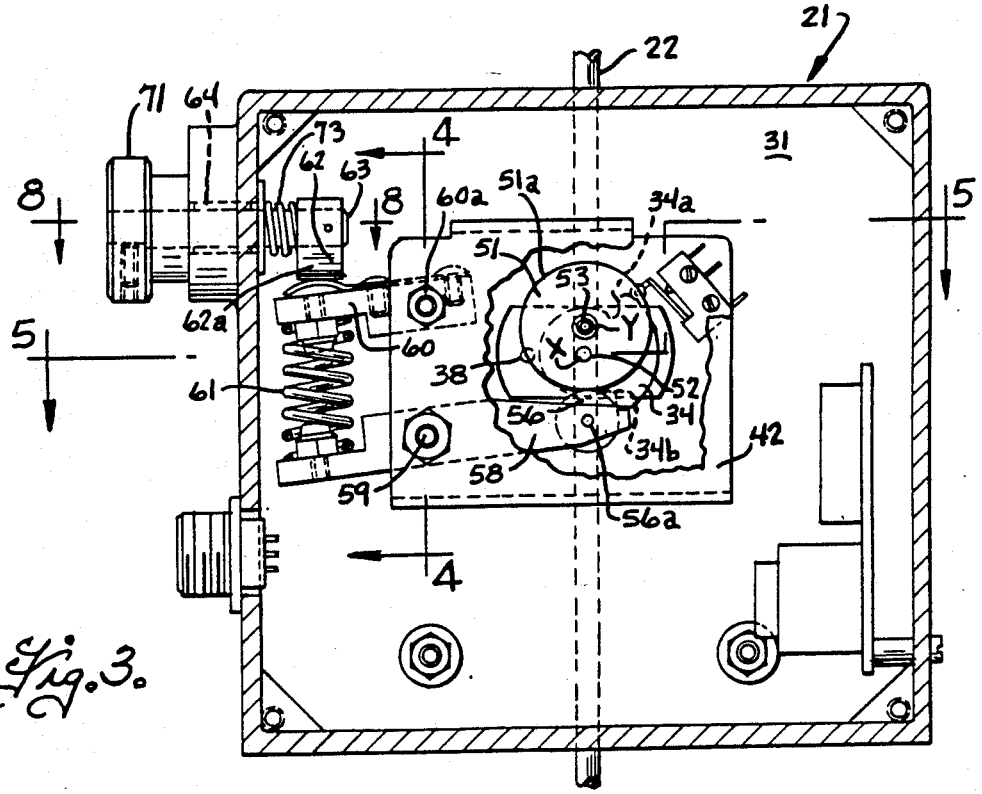
FIG. 3 is a fragmentary vertical sectional view taken on the plane 3—3 of FIG. 2 on a larger scale than FIG. 2.

Referring now to FIGS. 1–9, the control box 21 includes a face wall 31 having an opening 32 therethrough. A bushing 33 is mounted in the opening 32 and is retained in position by a lock nut. The control arm shaft 23 is rotatably supported in the bushing 33 for turning about a control arm axis X and has a flange 34 at its inner end engaging the inner end of the bushing and a split ring 35 disposed in a groove intermediate its ends to retain the shaft 23 against axial movement. The stock loop sensing arm 22 extends through a transverse opening in the outer end of the shaft 23 and is locked in position by a locking knob 36. As best shown in FIGS. 3, 6 and 7, flange 34 has angularly spaced stop shoulders **34*a* and 34*b* that are arranged to engage a stop pin 38 on the control box housing. The stop shoulders 34*a* and 34*b* are angularly spaced apart a distance to allow the control arm to move through a first range of control arm positions when the control arm is positioned at one side of the stock reel and through a second range of control arm positions when the control arm is positioned at the opposite side of the stock reel. The stop shoulders 34*a* and 34*b* are preferably angularly spaced from the stop pin 38 such that, when the control arm 22 is in its vertical position as shown in FIG. 3, the stock loop sensing arm can move angularly through an angle of preferably greater than 90°, for example 110° or 120°, to a raised position at either side of the stock reel in which the control arm extends somewhat above a horizontal plane through the axis of shaft 23. The control arm 22 has a laterally extending stock engaging portion 22*a* (FIG. 1) such as a roller or the like at one end adapted to engage the stock and the effective length of the control arm can be adjusted by loosening the knob 36 and shifting the control arm relative to the shaft 23. A counterweight 37 is commonly provided on the control arm 22 at the side of the control arm shaft remote from the stock engaging means 22*a*, and the counterweight is adjustable along the control arm and adapted to be locked in adjusted position as by a thumb screw 37*a***, to adjust the force exerted by the control arm on the stock and adapt the apparatus for stock of different types and thickness.

In this embodiment, a control potentiometer 41 (FIG. 5) is mounted as by a bracket 42 on the inner side of the face wall 31 and the potentiometer has an input shaft 41*a* that is connected to the control arm shaft 23 for rotation therewith. As disclosed more fully in the aforementioned U.S. Pat. No. 4,578,621, the control potentiometer is connected through a control circuit to the motor 16 to drive the motor at a speed correlative with the angular position of the arm 22 in a manner to maintain a loop of stock between the stock advancing apparatus and the processing machine. The circuit as disclosed in that patent also includes means for changing the direction of rotation of the drive motor to adapt the device for payout or rewind and for operation with the control arm at either side of the reel, and also for changing the operating angle of the control arm.

The stock loop control arm contacts the stock loop extending from the stock feed apparatus and the control arm is moved upwardly by the stock as the size of the stock loop decreases. In operation, the control arm not only moves up and down with changes in the size of the stock loop, but sometimes bounces out of contact with the stock, which bouncing not only causes excessive cycling of the drive motor for the stock advancing apparatus, but also adversely affects control of the size of the stock loop. In accordance with the present invention, means are provided for damping swinging movement of the control arm. In general, the damping means includes a control arm cam means mounted for turning movement with the control arm about the control arm axis, a cam follower means operatively engaging the control arm cam means, and spring means for pressing the cam follower means against the control arm cam means. The control arm cam means and the cam follower means and the spring means are constructed and arranged to apply a torque to the control arm in a direction to oppose upward movement of the control arm and which increases as the control arm moves upwardly through at least a portion of the range of control arm positions and decreases as the control arm moves downwardly.

The control arm cam means includes a cam 51 that is connected to the control arm shaft 23 for rotation therewith. As best shown in FIGS. 3 and 5–7 the cam 51 is mounted on the flange 34 of the control arm shaft 23 by a pin 52 and fastener 53. The pin is disposed in an axial bore in one end of the shaft 23 and extends into a bore in the cam 51 and the fastener 53 extends through the cam 51 and into the shaft 23 to secure the cam to the shaft for rotation therewith. As shown in FIG. 5, the input shaft 41*a* of the potentiometer 41 extends axially of the control arm axis into the bore in the cam 51 and is non-rotatably pinned or keyed to the cam member for rotation with the control arm shaft. The cam 51 has an annular cam surface 51*a* eccentric to the axis of rotation of the control arm shaft 23. The cam surface 51*a* is preferably of circular configuration having an arc-center at "Y" parallel to and radially spaced from the control arm axis "X" by a preselected virtual crank radius or "throw". The cam follower means includes a cam follower 56 operatively engaging the cam 51 and mounted as by a lever 58 for movement along a path generally radially of the control arm axis. The lever 58 is pivotally mounted by a lever pivot 59 for movement about a lever axis spaced from and preferably parallel to the control arm axis and the follower 56 is mounted on the lever at a location spaced from the lever axis. The spring comprises an extensible and contractable spring 61 that engages the lever to press the follower 56 against the control arm cam. The cam 51 and cam follower 56 are advantageously arranged to have rolling contact with each other to minimize frictional resistance to relative movement therebetween and, in this embodiment, the cam follower is in form of roller rotatably mounted as by a pin 56*a* on the lever 58 and having rolling contact with the cam surface 52*a*. Alternatively, the cam and cam follower can be constructed and arranged as more fully disclosed hereinafter in connection with the embodiment of FIGS. 10–13. When the cam follower 56 is pressed against the control arm cam, that component of the cam follower force on the control arm cam that extends through the control arm axis will not produce torque on the other control arm shaft. In the following description, a plane through the control arm axis and the point of contact of the cam follower 56 with the control arm cam surface 51*a* is hereinafter referred to as the "neutral" plane. The spring of the arc-center "y" of the control arm cam is hereinafter referred to as the effective cam arm of the control arm cam.

As best shown in FIG. 3, the cam follower 56 is arranged on the lever 58 and in relation to cam 51 such that, when the control arm 22 is disposed generally upright, the cam follower engages the cam surface 51*a* at a "minimum dead center position", that is at the point of minimum eccentricity of the cam surface relative to the control arm axis, and with the arc center Y of the eccentric cam surface 52*a* disposed substantially in the "neutral" plane through the control arm axis X and the point of contact of the cam follower with the cam surface 52*a*. Thus, in the upright control arm position shown in FIG. 3, the effective cam arm of the control arm cam is zero and pressure applied by the cam follower against the cam surface does not produce a torque in either direction on the control arm. However, when the control arm 22 is moved angularly in either direction from the upright position shown in FIG. 3, the arc center of the cam surface 51*a* shifts out of the neutral plane in a direction and distance correlative with the direction and angular movement of the control arm out of its upright position. More specifically, as the control arm is moved counterclockwise from the upright position shown in FIG. 3 to positions at a first side of the control arm axis (positions at the right side of the control arm axis as shown in FIG. 6), the arc center Y of the cam surface shifts to the left of the neutral plane and pressure applied by the cam follower 56 to the cam 51 will produce a clockwise torque to the control arm to oppose upward movement of the control arm at the first side of the control arm axis. Similarly, when the control arm is moved clockwise from the upright position shown in FIG. 3 to positions at a second side of the control arm axis (positions at the left side of the control arm axis as shown in FIG. 7), the arc center Y of the cam surface shifts to the right of the neutral plane and pressure applied by the cam follower to the cam 51 will produce a counterclockwise torque on the control arm to oppose upward movement of the control arm at the second side of the control arm axis. The effective cam arm, that is the spacing of the arc center Y of the cam surface 51*a* from the neutral plane increases as the control arm moves upwardly from the upright position shown in FIG. 3 toward a horizontal position. In addition, as the cam 51 is moved angularly from the position shown in FIG. 3, it moves the cam follower 56 in a direction to increase the deflection of spring 61 and thereby increase the pressure applied by the cam follower to the cam. Thus, as the control arm moves the cam in either direction from its minimum dead center position shown in FIG. 3, the cam follower is operative to apply a torque to the control arm in a direction to oppose upward movement of the control arm, which torque increases as the control arm moves upwardly and decreases as the control arm moves downwardly.

Provision is made for adjusting the minimum pressure applied by the spring 61 to the cam follower, to adapt the stock advancing apparatus for handling stock of different types and weight. As shown in FIGS. 3, 6 and 7, spring 61 is a coil type compression spring having one end engaging the lever 58 and its other end engaging an adjustable abutment 60. The abutment 60 is conveniently pivotally mounted by a pin 60*a* on the control box for movement about an axis parallel to the lever axis. A selectively adjustable cam 62 operatively engages the abutment 60 at a location spaced from its pivot axis to adjust the abutment 60 toward and away from the lever 58. The cam 62 is non-rotatably secured to a shaft 63 that extends through a bushing 64 in a wall of the control box and is rotatably and slidably mounted thereon. The cam has a peripheral cam surface 62*a* operative when its point of minimum eccentricity engages the abutment 60, hereinafter referred to as the zero position of the cam, to apply a minimal and preferably substantially zero force to the end of the compression spring so that the lever 58 presses the cam follower 56 against the cam member 57 with a minimum and preferably substantially zero force. As the cam 62 is turned from the zero position it forces the abutment 60 toward the lever 58 to progressively compress the spring 61 so that the cam follower 56 on the other end of the lever 58 is forced against the control arm cam with a cam follower pressure that increases as the rotary cam 62 is turned from the zero position. In this manner, the minimum force exerted by the cam follower on the control arm cam 51 can be selectively increased by rotating the cam 62 away from the zero position and decreased by rotating the cam 62 back toward the zero position. A knob 71 is connected to the cam 62 for rotating the cam to different angularly adjusted positions and for retaining the cam in the different angularly adjusted positions. As best shown in FIGS. 5, 8 and 9, the knob 71 is non-slidably and non-rotatably connected to the shaft 63 as by a pin 72. Shaft 63 is slidably and rotatably supported in the bushing 64 and a compression spring 73 is interposed between the cam 62 and the control box housing to yieldably urge the cam and knob axially in one direction to the axial position a shown in FIG. 8. Detent means are provided between the knob and the control box housing for retaining the cam 62 in different rotary positions. For this purpose, the knob 71 is provided with a plurality of circumferentially spaced openings or recesses 71*a* at locations spaced angularly about the axis of the shaft 63 and a pin 74 is mounted on the control box housing and is arranged to extend into any selected one of the recesses 71*a*. With this arrangement, the knob can be pulled axially against the compression of spring 73 and then turned to the desired angular position and, when the knob is released, it will move back to the axial position shown in FIG. 8 and the pin 74 will retain the knob and cam in that angularly adjusted position. To simplify manufacture, the cam surface 62*a* can conveniently be in the form of a circle eccentric to the axis of the shaft 63, it being understood that the cam could be provided with a differently shaped cam surface such as a spiral cam surface. In order to limit angular movement of the knob and cam, the knob 71 is also provided with an arcuate recess 71*b* (FIG. 9) concentric with the axis of the shaft 63 and arranged to receive a pin 78. Pin 78 extends from the control box housing a distance somewhat greater than the pin 74 and such that the pin 78 does not move out of the recess 71*b* when the knob is pulled axially for turning of the knob and cam to different angularly adjusted positions. The rotary cam 62 can be manually adjusted to adjust or preset the minimum pressure applied by the cam follower 56 to the control arm cam 51 and the control arm cam is arranged to increase the effective cam arm and the cam follower pressure applied thereto from the preset minimum pressure as the control arm moves toward its raised position.

As previously described the control potentiometer 41 is connected to the control arm 22 for angular movement therewith. As disclosed in the aforementioned U.S. Pat. No. 4,578,621, the control potentiometer is connected through a control circuit to the drive motor 16 to increase and decrease the speed of the drive motor in a manner to maintain a loop in the stock, and the control circuit is operable during payout and rewind of the stock and also when the control arm is at either side of the stock reel. In addition, the control circuit is adjustable to vary the angular position of the control arm at which the drive motor 16 is energized. The present invention provides apparatus for damping movement of the control arm in a manner to inhibit bouncing of the control arm on the stock. The damping action is selectively adjustable by means of the knob 71 and cam 62 and the control arm cam 51 has an eccentric cam surface 51*a* which is arranged to vary the torque that opposes upward movement of the control arm as the angular position of the control arm changes. The cam 51 is arranged so it will operate to increase the torque opposing raising of the control arm as the control arm is raised at either side of the control arm axis.

In FIGS. 10–13 the invention is shown applied to a stock advancing apparatus 10' in the form of powered stock feed and/or straightening rolls driven by a drive motor 16 and having an on/off switch for controlling operation of the drive motor. The stock advancing apparatus shown in FIGS. 10–13 is generally similar to that described in connection with the embodiment of FIGS. 1–9 and like numerals followed by the postscript ' are used to designate corresponding parts. As in the preceding embodiment, the stock loop control arm 22' is mounted for lengthwise adjustment in a transverse opening in a control arm shaft 23' and is adapted to be locked in adjusted position by a knob 36' and adjustably counterbalanced by a weight 37'. Control arm shaft 23' is rotatably supported in a bushing 33' mounted in the face wall 31' of the control box 21' and a flange 34' on the inner end of the shaft 33' has angularly spaced shoulders (not shown) arranged to engage a stop pin 38', to limit angular movement of the control arm.

A control arm damping means is provided for damping moving of the control arm. In general, the damping means includes a control arm cam means mounted for turning movement with the control arm about the control arm axis, a cam follower means operatively engaging the control arm cam means, and spring means for pressing the cam follower means against the control arm cam means. In this embodiment, the control arm cam means includes a cam member 51' mounted for turning movement with the control arm shaft as by a pin 52′ and fastener 53′ and having cam surface 51*a*′ eccentric to the control arm shaft. A cam collar 55′ extends around the cam surface 51*a*′ and is rotatably supported thereon by a liner 55*a*′ of low friction bearing material. The cam follower means comprises a lever 58′ pivotally mounted at 59′ on the control box housing and having a cam follower face 56′ in rolling engagement with the outer periphery of the cam collar 55′. As in the preceding embodiment, a compression spring 61′ is mounted with one end engaging the lever 58′ at a location spaced from the lever pivot axis and with the other engaging an adjustable abutment 60′. Adjustable abutment 60′ includes a lever pivotally mounted at 60*a*′ on the control box and an adjustable cam 62′ secured to a shaft 63′ that extends through the face wall 31′ of the control box and is slidably and rotatably supported thereon. The adjustable cam 62′ has a cam surface 62*a*′ that is eccentric to the axis the shaft 63′ to adjust the compression of the spring 61′ and hence the force that biases the cam follower face against the collar 55′ on cam 51′. Abutment cam 62′ is conveniently adjusted by means of a knob 71′ that can be indexed to different annular positions as described in the embodiment of FIGS. 1–9.

In this embodiment, the drive motor 16′ for the stock advancing apparatus is operated under the control of the control arm 22′ by means of an on/off switch 41′ and a cam 42′ on the control arm shaft. Cam 42′ is mounted for turning movement with the control arm shaft 23′ as by the pin 52′ and fastener 53′. As disclosed more fully in the aforementioned U.S. Pat. No. 4,555,071, the switch 41′ is mounted on a sector plate 43′ that is supported on the bushing 33′ for angular adjustment about the axis of the control arm shaft. The sector plate has a fastener 44′ that extends through an arcuate slot 45′ in the face wall 31′, and the fastener 44′ can be loosened and then moved angularly in the slot 45′ to adjust the angular position of the switch 41′ and hence the position of the control arm at which the switch is actuated.

Figure 12:
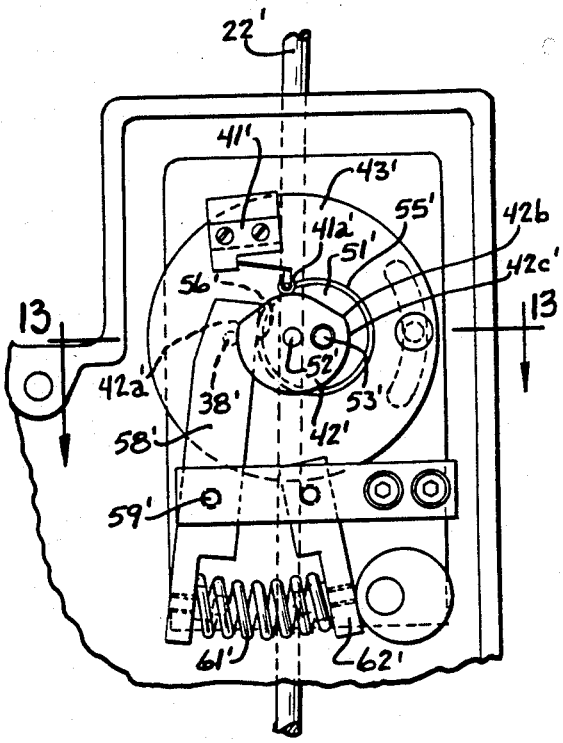
FIG. 12 is a fragmentary sectional view taken on the plane 12—12 of FIG. 11.
Figure 11:
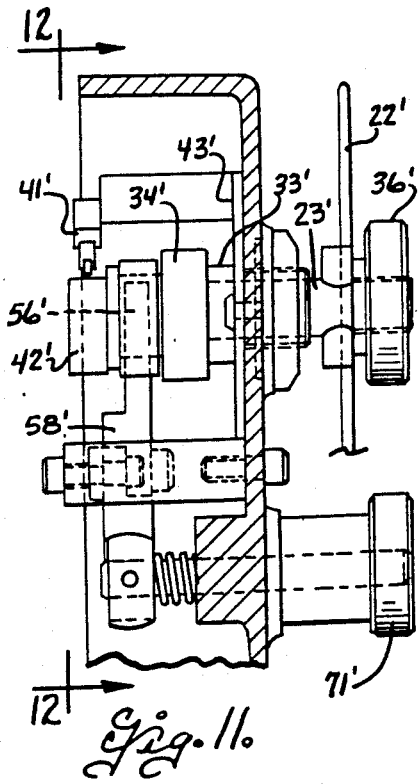
FIG. 11 is a fragmentary sectional view taken on the 11—11 of FIG. 10 and illustrating parts on a larger scale.

In some stock advancing apparatus, it is desirable to arrange the stock loop control arm 22′ for operation through a range of positions at either side of the control arm axis. As shown in FIG. 12, the cam 42′ has a first lobe 42*a*′ arranged to engage the actuator 41*a*′ on the switch 41′ when the control arm moves to a position at one side of the control arm axis and a second lobe 42*b*′ to engage the actuator of the switch 41′ when the control arm moves to a position at the other side of the control arm axis. Cam 42′ has a circular dwell portion 42*c*′ between lobes 42*a* and 42*b* with the radius the same as the apex of the lobes, to hold the switch actuator in its actuated position. Lobe 42*a*′ is arranged to engage the switch actuator when the control arm 22′ moves upwardly through a range of positions at one side (to the left as viewed in FIG. 12.) of the control arm axis and lobe 42*b*′ is arranged to engage the switch actuator when the control arm moves upwardly at the other side of the control arm axis. The angular position at which the lobe 42*a*′ or 42*b*′ will engage the switch actuator can be adjusted by adjusting the sector plate 43′ relative to the control box housing.

As is apparent, bouncing of the control arm when the control arm angular position is near the position at which one or the other of the lobes 42*a*′ or 42*b*′ actuates the switch 41′, will cause cycling of the drive motor on and off and can result in excessive wear and/or damage to the drive mechanism and erratic operation of the stock advancing apparatus. Movement of the control arm is dampened by the variable damping means including the control arm cam member 51′ and the cam follower 56′ and spring 61 and damping of the control arm is selectively adjustable by means of cam 62′ and knob 71′. The cam surface 51*a*′ on the cam member 51 is eccentric to the control arm axis and the control arm cam member is arranged so as oppose upward movement of the control arm with a minimum torque when the control arm 22′ is in an upright position shown in FIG. 12, and to increase the torque as the control arm moves toward a raised position. As the control arm cam 51′ moves in either direction from the position shown in FIG. 12, it increases the compression on spring 61′ and thereby increases the cam follower force on the control arm cam 51′, and also increases the effective cam arm at which the cam follower force is applied. The increase in the cam follower force and the increase in the effective cam arm at which the cam follower force acts on the control arm cam, applies a torque to the control arm in a direction to oppose upward movement of the control arm and which opposing torque increases as the control arm moves upwardly.

The embodiments of the invention in which an exclusive property or privilege is claimed are defined as follows:

1. A stock advancing apparatus for advancing flexible stock to or from a stock processing machine comprising, support means, rotary stock advancing means on the support means, a drive motor for driving the stock advancing means, a stock loop control arm mounted on the support means for swinging movement about a control arm axis, said stock loop control arm being adapted to engage a loop of stock intermediate the stock advancing apparatus and the stock processing machine and to be moved upwardly thereby through a range of control arm positions, means responsive to movement of the control arm about the control arm axis for controlling operation of the drive motor to maintain a loop in the stock between the stock advancing apparatus and the stock processing machine, means for damping movement of the stock loop control arm about said control arm axis, said damping means including control arm cam means mounted for turning movement with the control arm about the control arm axis, cam follower means operatively engaging said control arm cam means, and spring means engaging said cam follower means for pressing the cam follower means against the control arm cam means, the control arm cam means and the cam follower means and the spring means being constructed and arranged to apply torque to the control arm in a direction to oppose upward movement of the control arm and which increases as the control arm moves upwardly through at least a portion of said range of control arm positions and decreases as the control arm moves downwardly.

2. A stock advancing apparatus according to claim 1 wherein said control arm cam means increases deflection of said spring means as the control arm moves upwardly.

3. A stock advancing apparatus according to claim 1 wherein said cam follower means includes a lever pivotally mounted on the support means for movement about a lever axis, and means on the lever spaced from the level axis operatively engaging said control arm cam means.

4. A stock advancing apparatus according to claim 1 including manually adjustable means engaging said spring means for presetting a minimum deflection of said spring means, said control arm cam means increasing the deflection of said spring means as the control arm moves upwardly.

5. A stock advancing apparatus according to claim 1 wherein said cam follower means includes a lever pivotally mounted on the support means for movement about a lever axis and means on the lever spaced from the lever axis operatively engaging said control arm cam means, said spring means comprising a coil spring having opposite ends, one end of said coil spring operatively engaging said lever at a location spaced from the lever axis, selectively adjustable means operatively engaging the other end of said coil spring for presetting a minimum deflection of said coil spring, said control arm cam means increasing the deflection of said coil spring as the control arm moves upwardly.

6. A stock advancing apparatus according to claim 1 wherein said cam follower means includes a lever pivotally mounted on the support means for movement about a lever axis and means on the lever spaced from the lever axis operatively engaging said control arm cam means, said spring means comprising a compression type coil spring having opposite ends, one end of the coil spring engaging said lever at a location spaced from the lever axis, adjustable spring abutment means operatively engaging the other end of said coil spring, and manually operable means for adjusting said abutment means to preset a minimum compression of said coil spring, said control arm cam means being arranged to increase the compression of said coil spring as the control arm moves upwardly.

7. A stock advancing apparatus according to claim 6 wherein said adjustable abutment means includes a rotary cam, said manually operable means including a knob connected to said rotary cam for rotating the latter to different angular positions, and index means for releasably retaining said rotary cam in different angular positions.

8. A stock advancing apparatus according to claim 6 wherein said adjustable abutment means includes a rotary cam, a knob connected to said rotary cam for rotating the latter, means mounting the knob on said support means for axial sliding and rotary movement relative thereto about a rotary cam axis, means yieldably urging the knob axially in one direction tp a first axial position on said support means, one of the items comprising the knob and the support means having a plurality of recesses angularly spaced around the rotary cam axis and the other of the items comprising the knob and the support means having stop means receivable in different ones of said recesses in different angular positions of the knob, the knob being adapted to be manually moved axially in a direction opposite said one direction and then turned to rotate the rotary cam to different angular positions.

9. A stock advancing apparatus for advancing flexible stock to or from a stock processing machine comprising, support means, rotary stock advancing apparatus on the support means, a drive motor for driving the stock advancing means, a stock loop control arm mounted on the support means for swinging movement about a control arm axis, said stock loop control arm being positionable to engage stock extending from a first side of the stock advancing apparatus and to be moved upwardly thereby through a first range of control arm positions, the stock loop control arm being positionable to engage stock extending from a second side of the stock advancing apparatus for movement upwardly thereby through a second range of control arm positions, means responsive to movement of the control arm about the control arm axis for controlling operation of the drive motor to maintain a loop in the stock extending from the stock advancing apparatus, means for damping movement of the stock control arm, said damping means including control arm cam means mounted for turning movement about the control arm axis, cam follower means operatively engaging said control arm cam means, and spring means engaging said cam follower means for pressing the cam follower means against the control arm cam means, the control arm cam means and the cam follower means and the spring means being constructed and arranged (a) to apply torque to the control arm in a first direction to oppose upward movement of the control arm in said first range of positions and which increases as the control arm moves upwardly through at least a portion of said first range of control arm positions, and (b) to apply torque to the control arm in a second direction to oppose upward movement of the control arm in said second range of positions and which increases as the control arm moves upwardly through at least a portion of said second range of positions.

10. A stock advancing apparatus according to claim 9 wherein said control arm cam means increases the deflection of said spring means as the control arm moves upwardly through either of said first or second range of positions.

11. A stock advancing apparatus according to claim 9 including manually adjustable means engaging said spring means for presetting a minimum deflection of said spring means, said control arm cam means increasing the deflection of said spring means as the control arm moves upwardly through either of said first or second range of positions.

12. A stock advancing apparatus according to claim 9 wherein said cam follower means includes a lever pivotally mounted on the support means for movement about a lever axis and means on the lever spaced from the lever axis operatively engaging said control arm cam means, said spring means comprising a coil spring having opposite ends, one end of said coil spring operatively engaging said lever at a location spaced from the lever axis, selectively adjustable means operatively engaging the other end of said coil spring for presetting a minimum deflection of said coil spring, said control arm cam means increasing the deflection of said coil spring as the control arm moves upwardly through either of said first or said second range of positions.

13. A stock advancing apparatus according to claim 9 wherein said cam follower means includes a lever pivotally mounted on the support means for movement about a lever axis and means on the lever spaced from the lever axis operatively engaging said control arm cam means, said spring means comprising a compression type coil spring having opposite ends, one end of the coil spring engaging said lever at a location spaced from the lever axis, adjustable spring abutment means operatively engaging the other end of said coil spring; manually operable means for adjusting said abutment means to preset a minimum compression of said coil spring, said control arm cam means being arranged to increase the compression of said coil spring as the control arm moves upwardly through either said first or said second range of positions.

14. A stock advancing apparatus according to claim 13 wherein said adjustable abutment means includes a rotary cam, said manually operable means including a knob connected to said rotary cam for rotating the latter to different angular positions, and index means for releasably retaining said rotary cam in different angular positions.

15. A stock advancing apparatus according to claim 13 wherein said adjustable abutment means includes a rotary cam, a knob connected to said rotary cam for rotating the latter, means mounting the knob on said support means for axial sliding and rotary movement relative thereto about a rotary cam axis, means yieldably urging the knob axially in one direction to a first axial position on said support means, one of the items comprising the knob and the support means having a plurality of recesses angularly spaced around the rotary cam axis and the other of the items comprising the knob and the support means having stop means receivable in different ones of said recesses in different angular positions of the knob, the knob being adapted to be manually moved axially in a direction opposite said one direction and then turned to rotate the rotary cam to different angular positions.

16. A stock advancing apparatus for advancing flexible stock to or from a stock processing machine comprising, support means, rotary stock advancing means on the support means, a drive motor for driving the stock advancing means, a stock loop control arm mounted for swinging movement about a control arm axis and adapted to engage a loop of stock intermediate the stock advancing means and the stock processing means, means responsive to swinging movement of the control arm about the control arm axis for controlling operation of the drive motor to maintain a loop of stock between the stock advancing apparatus and the stock processing machine, means for controlling swinging movement of the stock loop control arm about said control arm axis, said last mentioned means including a control arm cam means mounted for turning movement with the control arm about said control arm axis, a lever pivotally mounted on the support for movement about a lever axis and cam follower means on the lever spaced from the lever axis and operatively engaging said control arm cam means, adjustable abutment means including a selectively adjustable cam mounted for turning about a cam axis and having a peripheral cam surface eccentric to said cam axis, compression spring means operatively engaging said lever and said adjustable abutment means for biasing said lever in a direction to press the cam follower means against the control arm cam means, and manually operable means for turning said selectively adjustable cam about its axis to adjust the compression on said compression spring means.

17. A stock advancing apparatus according to claim 16 wherein said means for turning said selectively adjustable cam includes a knob connected to the selectively adjustable cam for rotation as a unit therewith, means mounting the knob on the support means for axial sliding and rotary movement relative thereto, means biasing the knob axially in one direction to a first axial position on the support means, one of the items comprising the knob and the support means having a plurality of recesses therein angularly spaced about the axis of the selectively adjustable cam and the other of the items comprising the knob and the support means having stop means receivable in different ones of said recesses in different angular positions of the knob, the knob being adapted to be manually moved axially in a direction opposite said one direction and then turned to rotate the selectively adjustable cam to different angular positions.

* * * * *